US008528907B1

(12) United States Patent
Musuluri

(10) Patent No.: US 8,528,907 B1
(45) Date of Patent: Sep. 10, 2013

(54) INVESTING CARD GAME AND METHOD

(76) Inventor: Aravind Musuluri, Birmingham, AL (US)

( * ) Notice: Subject to any disclaimer, the term of this patent is extended or adjusted under 35 U.S.C. 154(b) by 0 days.

(21) Appl. No.: 13/094,603

(22) Filed: Apr. 26, 2011

Related U.S. Application Data

(60) Provisional application No. 61/328,041, filed on Apr. 26, 2010.

(51) Int. Cl.
*A63F 1/00* (2006.01)

(52) U.S. Cl.
USPC ..... 273/292; 273/297; 273/293

(58) Field of Classification Search
USPC ..... 273/297, 292
See application file for complete search history.

(56) References Cited

U.S. PATENT DOCUMENTS 6,497,410 B1 * 12/2002 Bernstein et al. ..... 273/297

* cited by examiner

*Primary Examiner* — Michael Dennis
(74) *Attorney, Agent, or Firm* — Ann I. Dennen; Lanier Ford Shaver & Payne P.C.

(57) ABSTRACT

The present disclosure is a method for playing an investing card game comprises the steps of providing a deck of financial instrument playing cards, dealing each of the financial instrument playing cards in rotation, and selecting one of the two or more players as the first initiating player. The method further comprises the steps of exposing a first financial instrument playing card in the hand of the first initiating player, selecting one of the key/value pairs, exposing, by each of the remaining players, one or more opposing financial instrument playing cards in the hands of the remaining players, and comparing the value of the selected key/value pair on the first financial instrument card to one or more values of the same key/value pair on the opposing financial instrument cards.

23 Claims, 9 Drawing Sheets

100

120

101 102

TBN Software Inc. (TBN)

103

TBN Software Inc. provides telecommunications software solutions, and information technology (IT) security services for telecommunications service providers. In addition, TBN Software offers custom solutions to commercial and government customers. The company was founded in 1989.

118 119

Industry: Telecom Sub-Industry: Telecom-Services

| | |
|---|---|
| 104 Price: | 111 98.76 |
| 105 PE: | 112 25.96 |
| 106 Revenue/employee: | 113 $98,012 |
| 107 PEG (5 year expected): | 114 1.35 |
| 108 Earnings Date: | 115 Dec 1, 2009 |
| 109 T&Q Recommendation: | 116 Underperform |
| 110 Dividend Yield: | 117 0.5% |

FIG. 1A

200

220

201 202

Pioneer Pollution Management Co. (PP)

203

Pioneer Pollution Co. engages in the manufacture and sale of water treatment equipment. It engages in designing, manufacturing, installing, and servicing waste water treatment equipment. The company was founded in 2002.

218 219

Industry: Manufacturing Sub-Industry: Pollution Control Equipment

| | |
|---|---|
| 204 Price: | 211 22.01 |
| 205 PE: | 212 30.78 |
| 206 Revenue/employee: | 213 $87,413 |
| 207 PEG (5 year expected): | 214 0.71 |
| 208 Earnings Date: | 215 Dec 22, 2009 |
| 209 T&Q Recommendation: | 216 Outperform |
| 210 Dividend Yield: | 217 0.0% |

FIG. 2A

INVESTING CARD GAME AND METHOD

BACKGROUND

Typically, a card game is often played with a standard deck of fifty-two playing cards that is divided into four suits. Each suit comprises thirteen cards ranking from an Ace to a King. A standard deck of cards also includes two or more joker cards. The joker cards are sometimes given a purpose in some card games. For example, the joker card may be a wild card, and any rank value may be applied to the card if the card is held and played during some card games.

One type of card game is a "trick-taking" game. A trick-taking card game refers to a card game having finite rounds referred to as "tricks." The object of a trick-taking card game is oftentimes tied to the number of tricks taken by a player. For example, the winner of the trick-taking card game may be the player who, at the end of the game, has the greatest number of tricks taken.

In a trick-taking game, an initiating player plays a first card of the trick. The remaining players play their cards in order according to the player's physical position. For example, the remaining players may play clockwise or counter-clockwise. During a trick, each player at his or her turn puts one card from his or her hand into play. Once each player has played a card, the trick is evaluated to determine the winner. The played cards are turned face down and removed from play. Oftentimes, the winner of the trick retains the played cards and puts the played cards in a physical location next to the winner of the trick. The game continues as described until all the cards in the deck of cards have been played and won.

Investing is tough. Like many other professional fields, the more experience one has investing, spending time, and understanding financial instruments e.g. stocks, the better he/she will become at investing. One way to gain valuable experience is by way of playing investing games. The present game not only helps the player understand investing concepts, but it also helps the players gain an appreciation for quantitative values encountered during investing process.

SUMMARY

The present disclosure generally pertains to investing card game systems and methods. A method for playing an investing card game in one exemplary embodiment comprises: (a) providing a deck of financial instrument playing cards, each financial instrument playing card in the deck of financial instrument playing cards belonging to a class of financial instruments and each financial instrument playing card in the deck of financial instrument playing cards having a front surface, the front surface of each card in the deck of cards comprising printed indicia indicative of a data identifying a financial instrument and printed indicia indicative of a set of statistics related to the financial instrument at a particular instance of time, the printed indicia indicative of the set of statistics comprising a plurality of key/value pairs, each key/value pair comprising a key identifying a type of statistic and a corresponding value for the key, wherein no two financial instrument playing cards in the deck of playing cards represents the same financial instrument at the same instance of time; (b) dealing each of the financial instrument playing cards in rotation to two or more players with each financial instrument playing card's front surface down, thereby creating a hand of financial instrument playing cards for each of the two or more players wherein the front surface of the financial instrument playing cards in each hand is not visible to the two or more players; (c) selecting one of the two or more players as the first initiating player to begin play leaving one or more remaining players; (d) exposing the first financial instrument playing card in the hand of the first initiating player so that the front surface of the first financial instrument playing card is exposed to the players; (e) selecting, by the first initiating player, one of the key/value pairs printed on the front surface of the first financial instrument card; (f) reading aloud the selected key/value pair by the first initiating player; (g) exposing, by each of the remaining players, the first financial instrument playing card in their hand; (h) comparing the value of the selected key/value pair on the first financial instrument card to one or more values of the same key/value pair on the opposing financial instrument cards; (i) determining a prevailing financial instrument card based upon the comparing step; (j) giving the first financial instrument card and the opposing financial instrument cards to the player holding the prevailing financial instrument card, the first financial instrument card and the opposing financial instrument cards representing a trick; (k) selecting a subsequent initiating player; (l) repeating steps (d) through (j), with the subsequent initiating player selected in step (k) replacing the first initiating player in step (d) until the game is complete; and (m) deciding which of the two or more players has won the game.

A system for playing an investing card game in one exemplary embodiment comprises memory for storing financial data indicative of a plurality of electronic financial instrument cards, the financial data for each of the plurality of financial instrument cards comprising data indicative of identifying the financial instrument and a set of statistics related to the financial instrument at a particular instance of time, the data indicative of the set of statistics comprising data indicative of a plurality of key/value pairs, each key/value pair comprising data indicative of a key identifying a type of statistic and a corresponding value for the key. In addition, the system comprises a display device and logic configured to display a graphical element to the display device indicative of a deck of cards, the logic further configured to retrieve from memory first financial data corresponding to one of the plurality of electronic financial instrument cards based upon a selection of the graphical element by the first player, to display a first electronic financial instrument playing card comprising the first financial data to the display device, and to display a first player identifier corresponding to the first electronic financial instrument playing card, the logic further configured to receive a selection from the first player of one of a plurality of displayed first electronic financial instrument card key/value pairs, retrieve from memory for each of the opposing players, financial data corresponding to one or more electronic financial instrument cards and display the electronic financial instrument card(s) to the display device along with the corresponding opposing player identifier upon selection by the first player of one of the plurality of displayed first electronic financial instrument card key/value pairs wherein none of the retrieved first player electronic financial instrument card and the opposing players electronic financial instrument cards represent the same financial instrument at the same instance of time, the logic further configured to compare the value of the selected first player electronic financial instrument card key/value pair to each of the values of the opposing player's electronic financial instrument card key/value pairs having the same key as the selected first electronic financial instrument card key/value pair, and determining, based upon the comparison a prevailing electronic financial instrument playing card, the logic further configured to display to the display device data indicative of which player identifier associated with the prevailing financial instrument playing card.

DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

FIG. 1A depicts a front of an exemplary financial instrument playing card in accordance with an embodiment of the present disclosure.

FIG. 2A depicts another front of an exemplary financial instrument playing card in accordance with an embodiment of the present disclosure.

DESCRIPTION

Figure 1B:
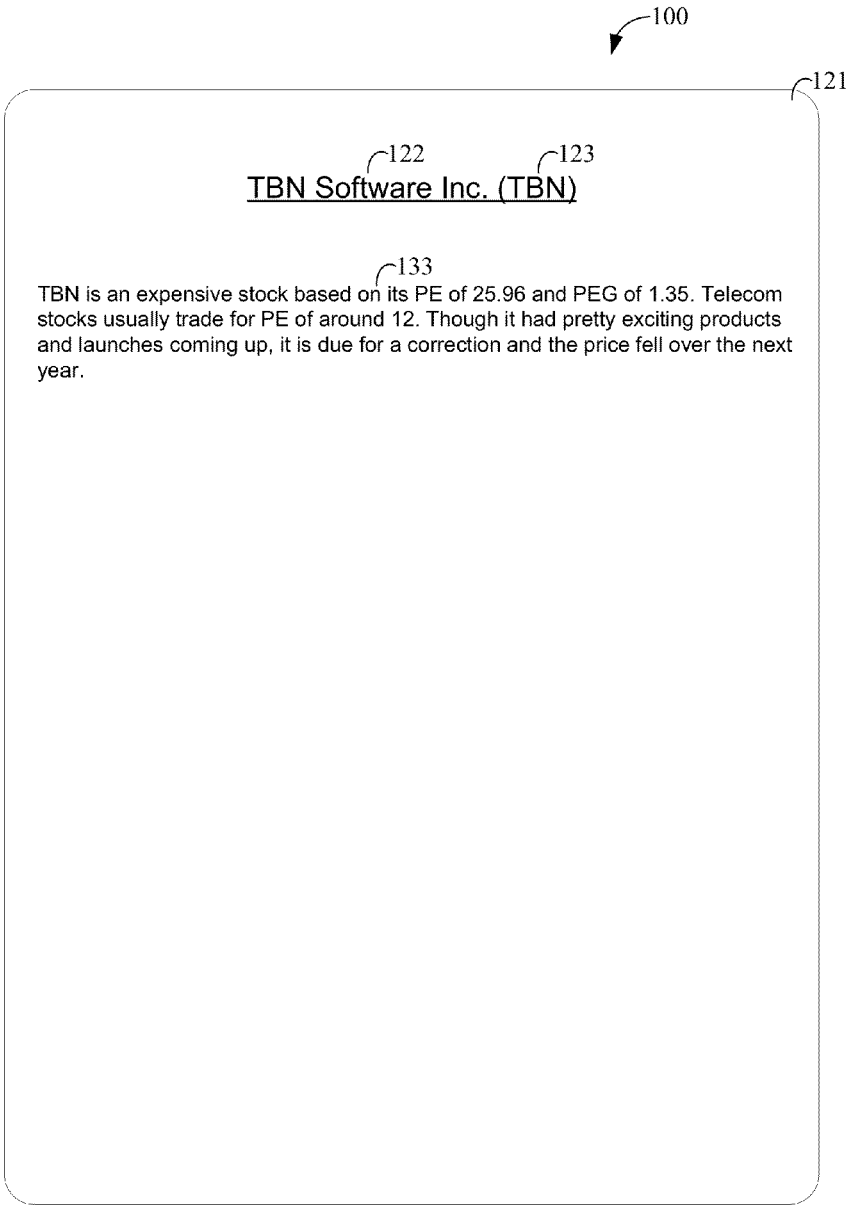
FIG. 1B depicts a back of the exemplary financial instrument playing card depicted in FIG. 1A.

FIG. 1A depicts a front surface 120 of a TBN financial instrument playing card 100 for playing an investing card game in accordance with an embodiment of the present disclosure. The financial instrument described by the TBN financial instrument playing card 100 belongs to the class of financial instruments known as stocks. Other financial instrument cards in other embodiments of the present disclosure may belong to other classes such as, mutual fund, Exchange-traded Fund (ETF), bond, option, future, swap, cap, floor, obligation, derivative, or the like. Note that the financial instrument card 100 may represent a real or a fictitious financial instrument.

The exemplary front surface of the TBN financial instrument playing card 100 comprises printed indicia indicative of a stock and a set of statistics related to the stock at a particular instance of time. In this regard, the TBN financial instrument playing card 100 comprises printed indicia 101 indicative of the name of the company, which in the exemplary financial instrument playing card is "TBN Software, Inc.," and the named company's corresponding symbol, identifier or Committee on Uniform Security Identification Procedure (CUSIP) number 102, which in the exemplary financial instrument playing card is "TBN." In addition, the exemplary financial instrument playing card 100 comprises optional printed indicia indicative of a description 103 of the company, the company's industry 118 and sub-industry 119. Note that in other embodiments of the present disclosure, on the front surface 120, the description 103 of the company, the company's industry 118 and/or sub-industry 119 may by replaced by other details regarding the company, which may include financial market conditions, economic indicators, hints and/or educational material. Other details regarding the company or market may be used in other embodiments of the present disclosure.

The set of statistics on the TBN financial instrument playing card 100 comprises printed indicia representing a plurality of keys 104-110 and associated key values 111-117, respectively. The keys 104-110 represent characteristics of the financial instrument identified by the name of the company 101 and the corresponding symbol 102, and the key values represent values associated with the corresponding keys 104-110 at a particular instance of time. Note that the key values may be fictitious or they may represent real statistics corresponding to the identified financial instrument. Also, note that the key values may be the latest available data or historical data corresponding to the identified financial instrument.

Specifically, the set of statistics printed on the exemplary TBN financial instrument playing card 100 comprises a "Price" key 104 and the corresponding price value 111, which in the exemplary financial instrument playing card 100 is "98.76." The price of a stock is that value for which one share of stock may be purchased. According to Generally Accepted Financial Principles (GAFP), stocks cannot be compared based on price. Such price, for example, is a neutral value in terms of the investing card game of the present disclosure, which is described further herein. A "neutral value" refers to a value of a key that cannot be used to determine a winner of a trick. In this regard, a key that has a neutral value is irrelevant to the investing card game of the present disclosure. However, its inclusion on the financial instrument playing card 100 is to confuse the initiating player. If the initiating player selects a key with neutral value, one of the opposing players can point this out and the opposing player who pointed this out wins the trick.

The set of statistics printed on the TBN financial instrument playing card 100 further comprises a price-to-earnings ratio (P/E) key, the "PIE" key 105, and the corresponding P/E value 112, which in the exemplary TBN financial instrument playing card 100 is "25.96." The "PIE" of a stock is a measure of the price paid for a share relative to the annual net income or profit earned by the company per share. According to GAFP, when stocks are being compared based on P/E, the lower the P/E value of a company the better the stock is for purchase than a financial instrument with a higher P/E value because a higher P/E means that investors are paying more for each unit of net income, so the stock is more expensive compared to one with a lower P/E. Such key and value relative to the investing card game of the present disclosure are described further herein.

The set of statistics printed on the TBN financial instrument playing card 100 further comprises a "Revenue/Employee" key 106 and the corresponding revenue/employee value 113, which in the exemplary financial instrument playing card 100 is "$98,012." Such revenue/employee value is the amount of revenue that is earned per employee over a twelve-month period. Thus, according to GAFP, when stocks are being compared based on Revenue/Employee the higher the revenue that is earned per employee, the better the stock is for purchase than a stock having a lower revenue/employee value. Such key and value relative to the investing card game of the present disclosure are described further herein.

The set of statistics of the TBN financial instrument playing card 100 further comprises a price/earnings to growth ratio (PEG) key, the "PEG" key 107 and the corresponding PEG value 111, which in the exemplary TBN financial instrument playing card 100 is "1.35." The "PEG" of a stock is the P/E divided by the company's expected average annual earnings growth rate over the next 5 years. Thus, according to GAFP, when stocks are being compared based on PEG the lower the PEG value the better the stock is for purchase than one with a higher PEG value. Such key and value relative to the investing card game of the present disclosure are described further herein.

The set of statistics of the TBN financial instrument playing card 100 further comprises an "Earnings Date" key 108 and the corresponding date value 115, which in the exemplary TBN financial instrument playing card 100 is "Dec. 1, 2009." Such a characteristic of the stock is a neutral value in that it cannot be used to compare stocks. Such key and value relative to the investing card game of the present disclosure is described further herein.

The set of statistics of the TBN financial instrument playing card 100 further comprises a "T&Q Recommendation" key 109 and the corresponding T&Q Recommendation value 116, which in the exemplary TBN financial instrument playing card 100 is "Underperform." Such a key and value of the stock indicates whether the stock would be a better purchase compared to another stock based upon the text associated with the T&Q Recommendation key 109. The T&Q recommendation value 116 is selected from the group including "Top Pick," "Buy," "Outperform," Market Perform," and "Underperform." In this regard, the text "Top Pick" means that the stock is a more worthwhile purchase than a stock having a T&Q recommendation of "Buy," "Buy" means that the stock is a more worthwhile purchase than a stock having a T&Q recommendation of "Outperform," "Outperform" means that the stock is a more worthwhile purchase than a stock having a T&Q recommendation of "Market Perform," and "Market Perform" is a more worthwhile purchase than a stock having a T&Q recommendation of "Underperform." Such key and value relative to the investing card game of the present disclosure is described further herein.

The set of statistics of the TBN financial instrument playing card 100 further comprises a "Dividend Yield" key 110 and the corresponding dividend yield value 117, which in the exemplary TBN financial instrument playing card 100 is "0.5%." The dividend yield value represents the dividend per share divided by the price per share. According to GAFP, when stocks are being compared based on dividend yield, the higher the dividend yield the better the stock is for purchase than a stock having a lower dividend yield. Such key and value relative to the investing card game of the present disclosure is described further herein.

Note that the keys 104-110 and their corresponding values 111-117 represent what is hereinafter referred to as a "key/value pair." Thus, the exemplary TBN financial instrument playing card 100 comprises a price key/value pair, a P/E key/value pair, a revenue/employee key/value pair, a PEG key/value pair, an earnings date key/value pair, a T&Q recommendation key/value pair, and a dividend yield key/value pair.

Note that the key/value pairs described hereinabove and printed on the TBN financial playing card 200 are for exemplary purposes only. Other key/value pairs representing other statistics associated with the financial instrument identified on the TBN financial instrument playing card 100 may be used in other embodiments of the present disclosure.

FIG. 1B depicts a back surface 121 of the financial instrument playing card 100 depicted in FIG. 1A. In the investing game of the present disclosure, the back surface 121 of the financial instrument playing card 100 may be used for educational purposes.

The back surface 121 of the financial instrument playing card 100 comprises printed indicia further describing the financial instrument described on the front surface 120 of the financial instrument playing card 100. In this regard, the back surface 121 comprises printed indicia 122 indicative of the name of the company, which in the exemplary financial instrument playing card is "TBN Software, Inc.," and the named company's corresponding symbol or CUSIP number 123, which in the exemplary financial instrument playing card is "TBN." Additionally, the back surface 121 comprises a detailed explanation 133 of the TBN stock, including an educational discussion of the company's and the stock's performance. Note that the back surface 121 of the financial instrument playing card 100 may be blank in other embodiments of the present disclosure. Note that the educational information on back surface 121 of the financial instrument playing card 100 may not be related to the front surface 120 of the financial instrument playing card 100 in other embodiments of the present disclosure.

FIG. 2A depicts another front surface 220 of a financial instrument playing card 200 for playing an investing card game in accordance with an embodiment of the present disclosure. Note that the financial instrument playing card 200 comprises data identifying a financial instrument and a set of corresponding statistics related to the financial instrument at a particular instance of time similar to the financial instrument playing card 100. The financial instrument described by the playing card 200 may belong to a particular class, which may include a stock, mutual fund, ETF, bond, option, future, swap, cap, floor, obligation, derivative, or the like.

Similar to the TBN financial instrument 100, the exemplary financial instrument playing card 200 describes a stock and a set of statistics related to the stock at a particular instance of time. In this regard, the financial instrument playing card 200 comprises the name of the company 201, which in the exemplary financial instrument playing card is "Pioneer Pollution Management Co.," and the named company's corresponding symbol, identifier or Committee on Uniform Security Identification Procedure (CUSIP) number 202, which in the exemplary financial instrument playing card is "PP." In addition, the exemplary financial instrument playing card 200 comprises a description 203 of the company, including the company's industry 218 and sub-industry 219. The financial instrument playing card 200 is hereinafter referred to as the PP financial instrument playing card 200.

The key/value pairs identifying the set of statistics on the financial instrument playing card 200 comprises printed indicia representing a plurality of keys 204-210 and associated key values 211-217, respectively. The keys 204-210 represent characteristics of the financial instrument identified by the name of the company 201 and the corresponding symbol 202, and the key values 211-217 represent values associated with the corresponding keys 204-217, similar to the TBN financial instrument playing card 100.

Specifically, the set of statistics printed on the exemplary PP financial instrument playing card 200 comprises a "Price" key 204 and the corresponding price value 211, which in the exemplary financial instrument playing card 200 is "22.01." In addition, the set of statistics printed on the PP financial instrument playing card 200 further comprises a price-to-earnings ratio (P/E) key, the "P/E" key 205, and the corresponding PE value 212, which in the exemplary financial instrument playing card 200 is "30.78." The set of statistics printed on the PP financial instrument playing card 200 further comprises a "Revenue/Employee" key 206 and the corresponding revenue/employee value 213, which in the exemplary financial instrument playing card 200 is "$87,413." The set of statistics of the PP financial instrument playing card 200 further comprises a "PEG" key 207 and the corresponding PEG value 214, which in the exemplary PP financial instrument playing card 200 is "0.71." The set of statistics of the PP financial instrument playing card 200 further comprises an "Earnings Date" key 208 and the corresponding date value 215, which in the exemplary PP financial instrument playing card 200 is "Dec. 22, 2009." The set of statistics of the PP financial instrument playing card 200 further comprises a "T&Q Recommendation" key 209 and the corresponding T&Q Recommendation value 216, which in the exemplary PP financial instrument playing card 200 is "Outperform," and the set of statistics of the PP financial instrument playing card 200 further comprises a "Dividend Yield" key 210 and the corresponding dividend yield value 217, which in the exemplary financial instrument playing card 200 is "0.0%."

Note that the key/value pairs described hereinabove and printed on the PP financial playing card 200 are for exemplary purposes only. Other key/value pairs representing other statistics associated with the financial instrument identified on the PP financial instrument playing card 200 may be used in other embodiments of the present disclosure.

Figure 2B:
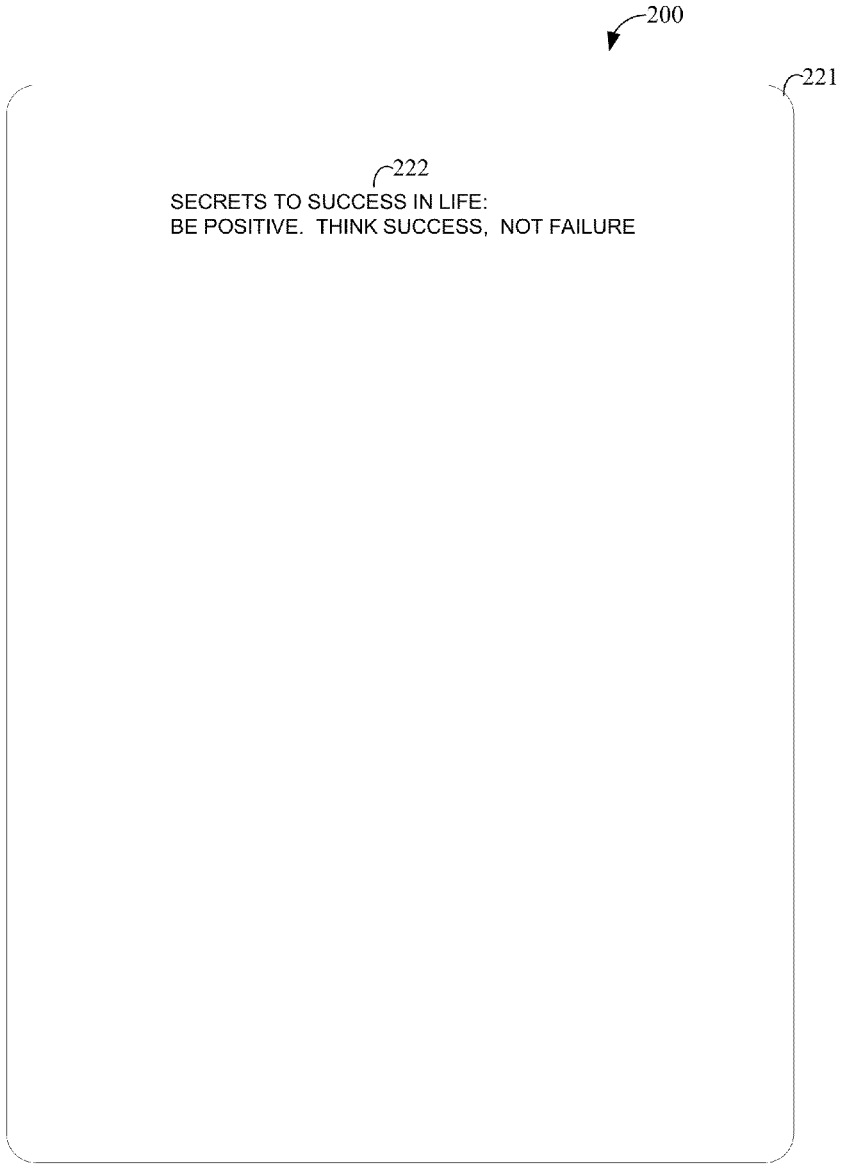
FIG. 2B depicts a back of the exemplary financial instrument playing card depicted in FIG. 2A.

FIG. 2B depicts a back surface 221 of the financial instrument playing card 200 depicted in FIG. 2A. In the investing game of the present disclosure, the back surface 221 of the financial instrument playing card 200 may be used for educational purposes.

The back surface 221 of the financial instrument playing card 200 comprises printed indicia 222 indicative of the secrets to success in life and is not related to the financial instrument described on the front surface 220 of the financial instrument playing card 200.

In playing an exemplary game of the present disclosure, a deck (not shown) of financial instrument playing cards, examples of which are the TBN financial instrument playing card 100 and PP financial instrument playing card 200, is used wherein each of the cards in the deck belongs to the same class of financial instruments and no two financial instrument playing cards represent the same financial instrument at the same instance of time. For example, for a particular game in accordance with an embodiment of the present disclosure all the financial instrument playing cards in the deck may comprise data indicative of stocks. Whereas, for a particular game in accordance with another embodiment of the present disclosure all the financial instrument playing cards in the deck may all comprise data indicative of bonds, and so forth. Other types of financial instruments may be used in other embodiments of the game of the present disclosure.

Note that in other embodiments of the present disclosure, all the financial instrument playing cards not only belong to the same class, but also may be further restricted by some other criteria. For example, in one embodiment, all the financial instrument playing cards in the deck may comprise data indicative of stocks belonging to the nuclear power industry. Whereas, in another embodiment, all the financial instrument playing cards in the deck may comprise data indicative of bonds maturing in the next two years, and so forth.

Notably, for the exemplary game, the keys on each of the cards in the deck are the same. However, the values corresponding to the keys on each of the cards differs in accordance with the identity of the financial instrument identified on each of the cards. For example, in the exemplary TBN financial instrument playing card 100 (FIG. 1) and PP financial instrument playing card 200 (FIG. 2), each card 100 and 200 has the same keys, i.e., Price, P/E, Revenues/Employee, PEG, Earnings Date, T&Q Recommendation, and Dividend Yield. However, the values for these keys are different on TBN financial instrument playing card 100 than they are on PP financial instrument playing card 200. For example, the "Price" key 104 on card 100 has a corresponding value 111 of "98.76," whereas the "Price" key 204 on card 200 has a corresponding value 211 of "22.01."

Further note that only two playing cards, including the TBN financial instrument playing card 100 and the PP financial instrument playing card 200, are shown for brevity and simplicity. However, a deck of playing cards may have any number of financial instrument playing cards, and each financial instrument playing card in accordance with an embodiment of the present disclosure would describe a respective financial instrument and its associated set of statistics at a particular instance of time.

Any number of players, e.g., two, three, four or more, may play the investing card game of the present disclosure. For purposes of illustration and description, the investing card game in accordance with an embodiment of the present disclosure is described hereafter where two players are playing the investing card game. Note that all the players need not be human beings. Players can be imaginary players or computing devices. The only difference between a human being player and imaginary player is that the imaginary player is prohibited from initiating a round.

For purposes of illustration, assume that the deck comprises fifty-two financial instrument playing cards. A dealer, which may be one of the two players, deals each of the fifty-two financial instrument playing cards one at a time face down in rotation to each of the two players such that each player has a card hand of twenty-six cards.

In one embodiment, the players are required to leave the cards face down and draw a card from the top of the face down stack of cards to play in a trick. In another embodiment, the players may be allowed to hold their hands so that the players can see the front surfaces of each of their respective cards, and the players may be allowed to select from the plurality of cards in their hands which card they desire to play.

The two players may determine in any number of ways which of the two players shall start a trick. Note that the investing card game of the present disclosure is a "trick-taking" game, and the term "trick" refers to a unit or round of play. Thus, one object of the game may be to win more tricks than the opposing player out of the entire deck, out of a portion of the deck, or over a given period of time.

In the present investing card game, a "trick" is the comparison of one of a player's financial instrument playing card key/value to the same key/value on one of the other player's financial instrument playing card. Such comparison, and the winning of the comparison, is the trick in the investing card game of the present disclosure. This is described further herein.

The player that initiates a trick selects a card from his/her twenty-six cards. In one embodiment of the investing card game, the player may select randomly or otherwise from the twenty-six cards. In another embodiment, the initiating player's hand comprises of a stack of cards that are in the reverse order in which they were dealt, and the player may be required to select the top card from the stack. In yet another embodiment, the player may select more than one card from the stack.

In addition to selecting a card from his/her twenty-six cards, the player may also identify a key/value pair that is to be used to determine which player wins the trick. In another embodiment of the present disclosure, the opposing player may be the one who identifies the key/value pair that is to be used to determine which player wins the trick. In yet another embodiment, the players may determine prior to the onset of the game any method of selecting a key/value pair during the investing card game of the present disclosure. For example, the players may determine before the game is started that the players will only compare the Revenue/Employee key/value pair during the course of the game. Other ways of selecting the key/value pair for comparison to determine the winner of a trick may be used in other embodiments of the investing card game of the present disclosure.

After selection of the first card for the trick and the determination of the key/value pair that will be used to determine who wins the trick, the initiating player turns over the card to expose the key/value pairs contained on the card. Thus, as an example, the initiating player may start the trick with the TBN financial instrument playing card 100 thereby exposing the key/value pairs contained on the TBN financial instrument playing card 100. Alternatively, the initiating player may read aloud the selected key/value pair, as determined as described above.

The second player in the investing card game then exposes his/her card or reads aloud the value of the key that is to be compared. Then, in accordance with GAFP, which is described above, the player whose key/value wins is determined.

As described above, according to GAFP, there may be particular keys for which the value is a neutral value. For example, as described above, price cannot be used to compare stocks. Thus, in order to win a trick in the exemplary investing card game when comparing the price key/value pair, the opposing player who points out that the key is a neutral value key wins the trick.

As described above, according to GAFP, it may be more beneficial to have a higher value corresponding to a particular key or it may be more beneficial to have a lower value corresponding to a particular key. For example, as described above, when comparing stocks by P/E the lower the P/E value the better the stock purchase. Thus, in order to win a trick in the exemplary investing card game when comparing the P/E key/value pair, the player with the lowest P/E value wins the trick. As another example, as described above, when comparing stocks by revenue/employee the higher the revenue/employee value the better the stock purchase. Thus, in order to win a trick in the exemplary investing card game when comparing the revenue/employee key/value pair, the player with the higher revenue/employee value wins the trick.

In addition, there may be particular keys for which the value is textual and a ranking order of textual variables for the key may be provided for determining whether one stock is more beneficial over another stock. For example, the "T&Q Recommendation" key may have values of "Top Pick," "Buy," "Outperform," "Market Perform," and "Underperform," which are enumerated here in ranked descending order from the best variable to the worst variable, i.e., "Top Pick" wins over "Buy," "Buy" wins over "Outperform," "Outperform" wins over "Market Perform," and "Market Perform" wins over "Underperform."

As an example, assume that the initiating player holds the TBN financial instrument playing card 100 as his first playing card. Further assume that the second player holds the PP financial instrument playing card 200. The initiating player may select the P/E key/value pair for comparison to determine who wins the trick. In such a comparison, the P/E value 212 on card 200 is 30.78, which is higher than the PE value 112 on card 100 at 25.96. Thus, in accordance with the GAFP described above, the lower P/E value wins the trick. Thus, the initiating player wins the trick.

After it is determined, based upon the key/value pair compared, the players may count the number of tricks that he/she has won, and the player with the most tricks may be the winner of the investing card game of the present disclosure. In one embodiment, after it is determined that a player has won a trick, the player who wins the trick retains both the initiating player's card and the other player's card. The winning player of the trick sets aside the pair of cards, i.e., the initiating player's card and the other player's card. In such an embodiment, the pair of cards is counted as one winning trick, and at the end of the investing card game, the players count up the number of cards that he/she retained, and the player with the most cards is declared the winner.

In one embodiment, this process of comparing cards continues until some predefined event occurs. In one embodiment of the investing game of the present disclosure, the game continues, and tricks are played, until all the cards in the players' hands have been used. In such an embodiment, the winning player is the player who holds the greatest number of tricks won. In another embodiment, this process may continue until one of the players reaches a threshold number of winning tricks, e.g., once one player wins ten tricks. In another embodiment, this process may continue for a predetermined amount of time. In such an embodiment, the winning player is the player who holds the greatest number of tricks won. Other predefined events for determining how long the game continues may be used in other embodiments of the investing game of the present disclosure.

The deck of cards used in playing the investing card game of the present disclosure may comprise one or more categories of "wild cards" to which certain rules may be applied. For example, there may be a card that trumps all other cards in the deck or there may be a card that always loses to every other card in the deck.

Figure 3:
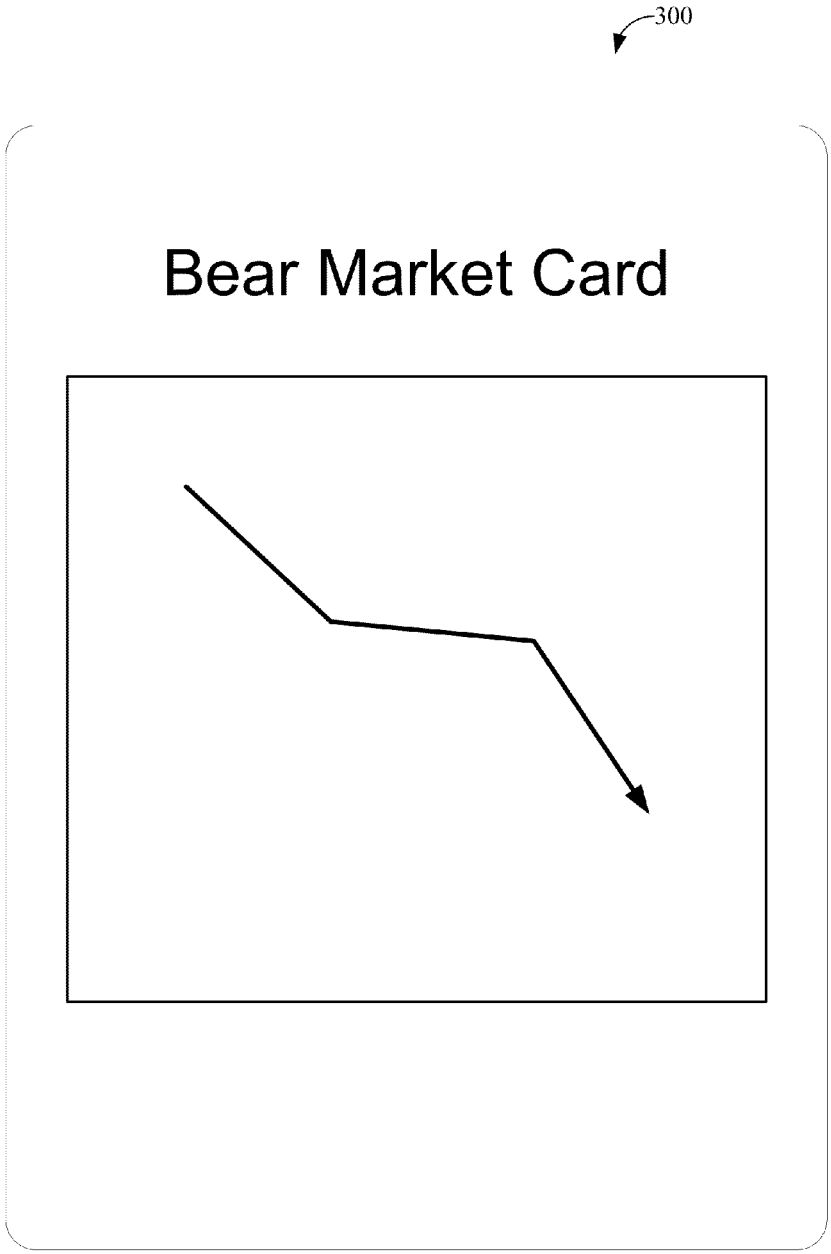
FIG. 3 depicts an exemplary "Bear Market" playing card in accordance with an embodiment of the present disclosure.
Figure 4:
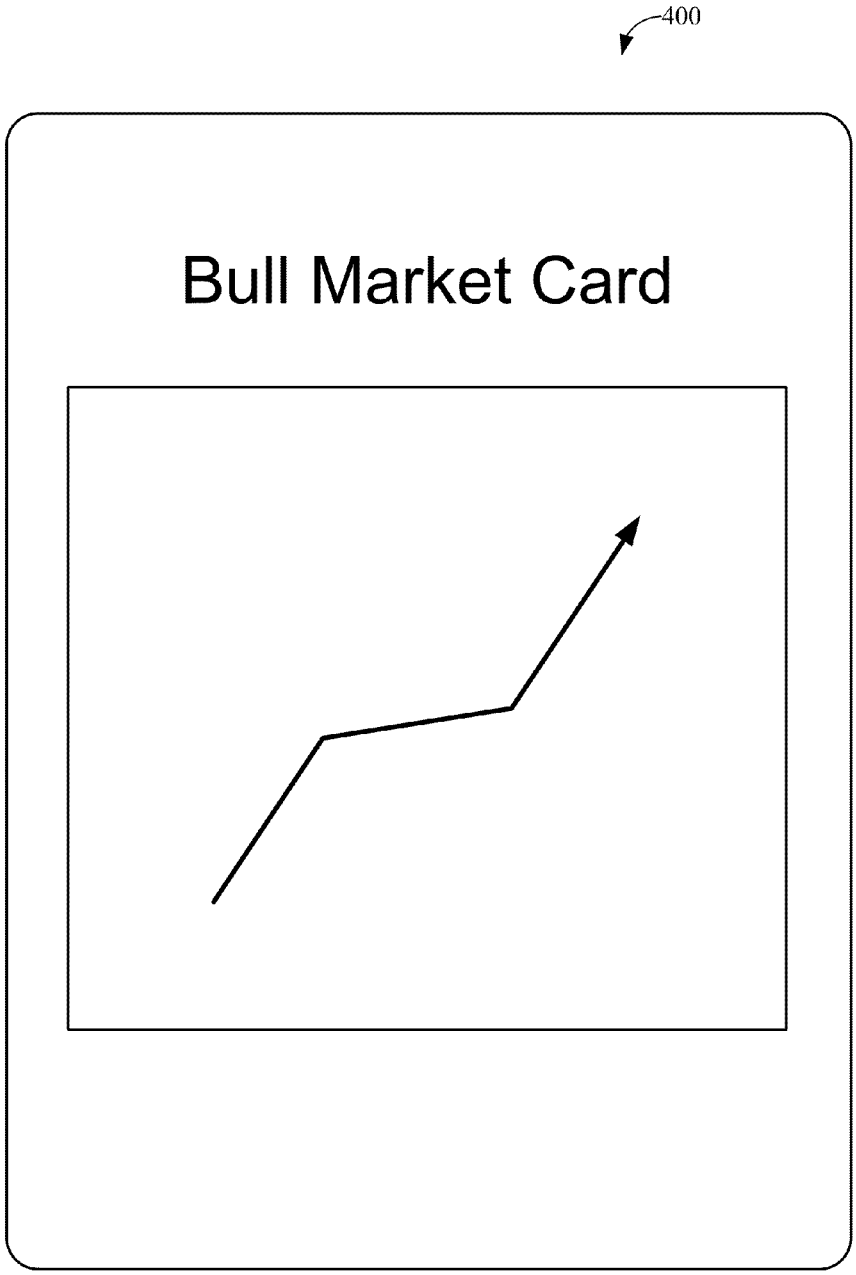
FIG. 4 depicts an exemplary "Bull Market" playing card in accordance with an embodiment of the present disclosure.

In this regard, in one embodiment, the deck of cards used in the investing card game further comprises at least one "Bear Market" playing card 300 depicted in FIG. 3 and at least one "Bull Market" playing card 400 depicted in FIG. 4. Notably, the deck may comprise a plurality of such cards 300 and 400.

In such an embodiment, the hand of cards dealt to the players may include one or more of the "Bear Market" playing cards 300 or "Bull Market" playing cards 400. During play, if a player pulls a "Bear Market" playing card 300 or otherwise plays a "Bear Market" playing card 300, the player will automatically lose the trick. In this regard, a "Bear Market" playing card 300 always loses to every other card in the deck.

If a player pulls a "Bull Market" playing card 400 or otherwise plays a "Bull Market" playing card 400, the player will automatically win the trick. In this regard, a "Bull Market" playing card 400 trumps or wins over every other card in the deck.

There are two embodiments of the investing card game of the present disclosure. There is a "long" version of the investing card game and a "short" version of the investing card game. Each is described further herein.

In the world of trading financial instruments, the term "long" refers to when a person or entity holds or owns a position in a security, e.g., a stock. One obtains a "long" position in a stock through a buy order and the person or entity would make a profit on the purchased stock when the price of the stock increases. When one has a "long" position on a stock, they own the stock, i.e., if one purchases a stock he/she is "long the stock." The person or entity creates a long position on a stock if they think that the price of the stock is going to increase. Thus, when looking at statistics related to a stock for which one desires to obtain a long position, one determines whether the stock has favorable statistics, i.e., a lower P/E, a higher revenue/employee, a lower PEG, a better T&Q identifier, or a higher dividend yield.

In the world of trading financial instruments, the term "short" refers to when a person or entity borrows securities, e.g., a stock to sell with the expectation that the price of the stock is going to decrease in the near future. The intent of "short" selling is to buy the stock back to replace the borrowed stock at a cheaper price. A "short" sale is the sale of stock that one does not own. Those who sell "short" believe the price of the stock will fall and he/she can buy the stock at the lower price and make a profit. Thus, when looking at statistics related to a stock for which one desires to obtain a short sale, one determines whether the stock has unfavorable statistics, i.e., a higher P/E, a lower revenue/employee, a higher PEG, a poor T&Q identifier, or a lower dividend yield.

The investing card game of the present disclosure can be played as a "long" version or as a "short" version in accordance with the "long" position and the "short" selling described hereinabove. In this regard, prior to initiation of the game, the players decide whether they will play the "long" version of the investing card game or the "short" version of the investing card game.

If the players decide to play the "long" version of the investing card game, then the investing card game is played as described hereinabove. That is, when price and earnings date are compared, the player that points out that these statistics are neutral wins the trick. If P/E is being compared in a round, the player with the lower P/E wins the trick. If revenue/employee is being compared, the player with the higher revenue/employee wins the trick. If PEG is being compared, the player with the lower PEG wins the trick. If T&Q recommendation is being compared, the player having a T&Q value that comes first in the ranking of "Top Pick," "Buy," "Outperform," Market Perform," and "Underperform" wins the trick. In this regard, for the "long" version, the text "Top Pick" wins over "Buy," "Buy" wins over "Outperform," "Outperform" wins over "Market Perform," and "Market Perform" wins over "Underperform." If dividend yield is being compared, the player with the higher dividend yield wins the trick.

If the players decide to play the "long" version of the investing card game and a player pulls a "Bull Market" playing card or otherwise plays a "Bull Market" playing card, the player will automatically win the trick. If a player pulls a "Bear Market" playing card or otherwise plays a "Bear Market" playing card, the player will automatically lose the trick.

However, if the player determine at the beginning of the game to play the "short" version, comparison of the statistical values changes somewhat. The price and the earnings date statistics are still neutral values and whichever player points out that such statistics, if selected, are neutral values wins the trick. However, if the short version is being played and P/E is being compared in a round, the player with the higher P/E wins the trick. If revenue/employee is being compared, the player with the lower revenue/employee wins the trick. If PEG is being compared, the player with the higher PEG wins the trick. If T&Q recommendation is being compared, the player having a T&Q value that comes first in the ranking of "Underperform," "Market Perform," "Outperform," "Buy," and "Top Pick" wins the trick. In this regard, for the "short" version, the text "Underperform" wins over "Market Perform," "Market Perform" wins over "Outperform," "Outperform" wins over "Buy," and "Buy" wins over "Top Pick." If dividend yield is being compared, the player with the lower dividend yield wins the trick.

If the players decide to play the "short" version of the investing card game the desirability of the wild cards is reversed as well. If the "short" version is being played and a player pulls a "Bull Market" playing card or otherwise plays a "Bull Market" playing card, the player will automatically lose the trick. If a player pulls a "Bear Market" playing card or otherwise plays a "Bear Market" playing card, the player will automatically win the trick.

In other embodiments of the present disclosure, the initiating player may determine before each round or trick to play the "long" version or "short" version for that particular round or trick. In yet another embodiment of the present disclosure, the opposing player or all the players collectively may determine before each round or trick to play the "long" version or "short" version for that particular round or trick.

Figure 5:
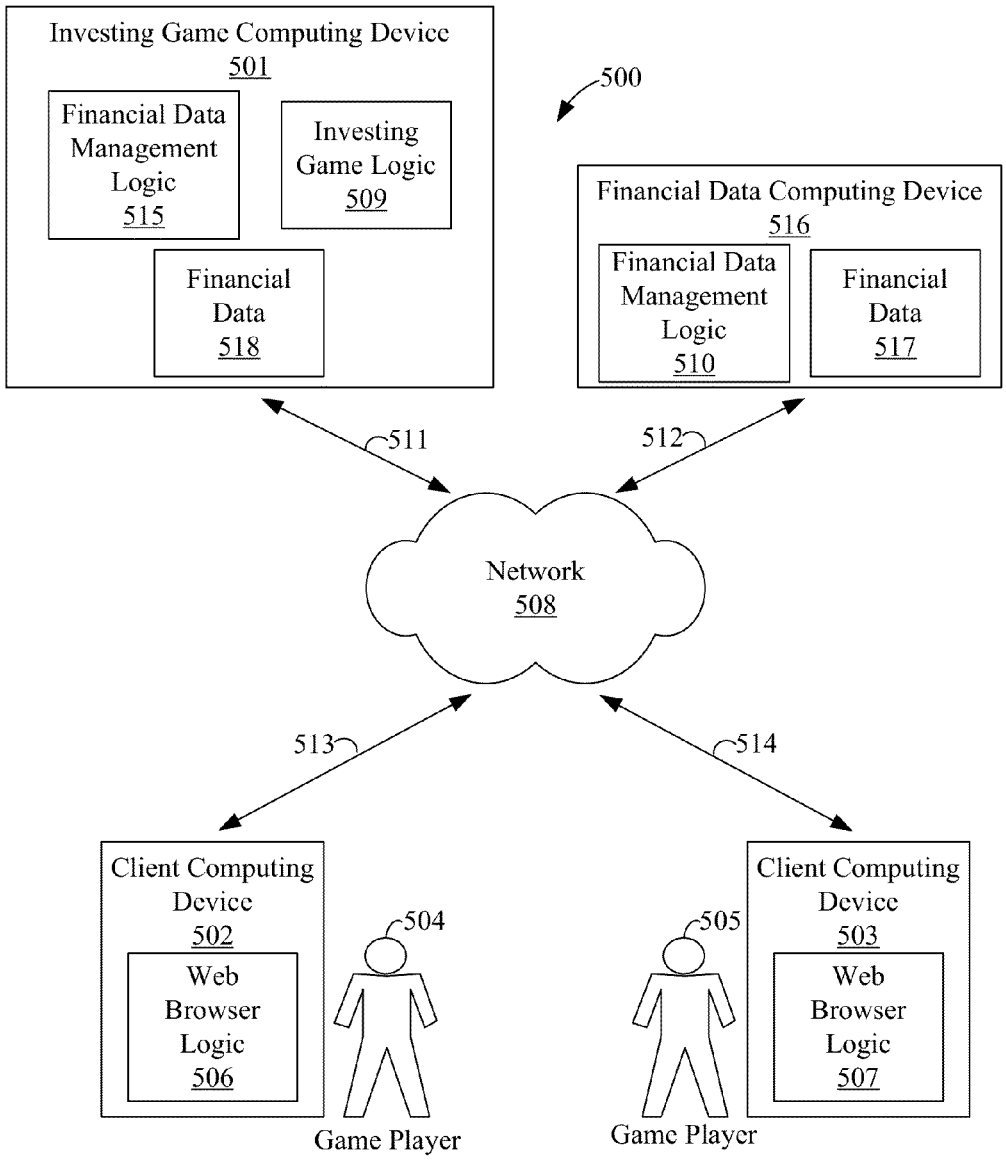
FIG. 5 depicts an exemplary system for playing an internet game in accordance with an embodiment of the present disclosure.

FIG. 5 depicts an investing game system 500 for playing an internet investing game in accordance with an embodiment of the present disclosure. The investing game system 500 comprises an investing game computing device 501 that is coupled to a network 508 via a communication link 511. The network 508 may be, for example, the Internet.

The system 500 further comprises client computing device 502 and client computing device 503. The client computing device 502 is communicatively coupled to the network 508 via a communication link 513, and the client computing device 503 is communicatively coupled to the network 508 via a communication link 514. Thus, the investing game computing device 501 communicates with the client computing device 502 and the client computing device 503 via the network 508 over the communication links 511, 513, and 514.

In one embodiment, the client computing device 502 and the client computing device 503 are personal computers (PCs). However, the client computing device 502 and the client computing device 503 may be other types of devices that communicatively couple to the network 508, including, for example, a laptop computer, or a video game console, or a handheld device, such as a personal digital assistant (PDA) or a cell phone.

The client computing device 502 and the client computing device 503 may be any type of device that is capable of receiving data input from a game player 504 and a game player 505, respectively, processing the data, and transmitting the data over the network 508. In addition, the client computing device 502 and the client computing device 503 are capable of receiving data from the network 508, processing the received data, and displaying the processed data via a display device (not shown). For example, in one embodiment, the network 508 is the Internet and Internet protocol (IP) packets are communicated between the customer computing devices 502 and 503 and the investing game computing device 501.

Note that two client computing devices 502 and 503 are shown in the exemplary system 500. However, the system 500 may include more or fewer client computing devices that connect additional or fewer game players to the investing game computing device 501. In this regard, one player may play alone or an arbitrarily large number of players may participate in the same internet investing game according to an embodiment of the present disclosure.

Further note that the player 504 is shown using his own client computing device 502 and player 505 is shown using his own client computing device 503 in the exemplary system 500. However, that is not necessary. In one embodiment multiple players can share the same client computing devices.

Further note that the client computing device 502 and the client computing device 503 may be connected to the network 508 via a variety of ways. For example, the client computing device 502 and the client computing device 503 may be connected to the network 508 through a local area network, a wireless connection, a cable modem, a dial-up connection, or the like. The communication links 513 and 514 shown are not to be limited in any way as to the method of connection to the network 508.

The investing game computing device 501 may offer a variety of ways by which the game player 504 and the game player 505 may play the investing game in accordance with an embodiment of the present disclosure. In the exemplary system 500, the investing game computing device 501 generates and makes available web pages (not shown) via investing game logic 509 reading or otherwise accessing financial data 518 that is displayed to the client computing device 502 and the client computing device 503. The game player 504 and the game player 505 may then play the investing game of the present disclosure via the web pages displayed by web browser logic 506 and 507, respectively. Further note that in other embodiments of the present disclosure the game player 504 and the game player 505 may play the investing game of the present disclosure via Graphical User Interfaces (GUI) (not shown) displayed by graphical application logic (not shown) on the client computing device 502 and client computing device 503. In which case, the investing game computing device 501 generates and makes available data (not shown) via investing game logic 509 reading or otherwise accessing financial data 518 that is compatible with the graphical application logic (not shown) on the client computing devices 502 and 503.

In another embodiment, the investing game computing device 501 may download parts of the financial data 518 and parts of the investing game logic 509 to the client computing device 502 and the client computing device 503. Such investing game logic may then be executed on the client computing devices 502 and 503, and the client computing device 502 and the client computing device 503 may communicate directly with one another via the network 508 to play the investing game of the present disclosure. In addition, the gaming logic, when executed, may enable the game players 504 and 505 to play the game singly without communication with another game player 504 and 505.

In yet another embodiment, if the financial data 518 and the investing game logic 509 to play the investment game are already available in the memory of the client computing device, e.g., through a compact disc (CD), then the network 508 and the investment game computing device 501 are optional. In this regard, the investing card game may be played via a game console, e.g., Nintendo™, Wii™ or the like, by inserting the CD into the game console without the need of the investing game computing device 501.

In addition to the investing game logic 509 and the financial data 518, the investing game computing device 501 may further comprise financial data management logic 515. The financial data management logic 515 is logic for accessing, reading or otherwise managing the financial data 518. The financial data 518 comprises data indicative of a plurality of electronic financial instrument cards, as described above. In this regard, the financial data 518 comprises a plurality of financial instrument identifiers (not shown) and associated with the financial instrument identifiers in the financial data 518 is the financial instrument descriptive information at various points in time (not shown) and the financial instrument statistical data at various points in time (not shown), as described above. As an example, the financial data management logic 515 may store the data indicative of the TBN financial instrument playing card 100 (FIG. 1) in the financial data 518. The financial data 518 correlates with the data indicative of the TBN financial instrument playing card 100 the TBN description 103 at a particular instance of time (FIG. 1) and the statistical data at a particular instance of time, including the keys 104-110 (FIG. 1) and their corresponding values 111-117 (FIG. 1).

The financial instrument data 518 may be real or fictitious data describing imaginary financial instruments, e.g., stocks, mutual funds, ETFs, bonds, options, futures, swaps, caps, floors, obligations, or the like. However, in one embodiment of the present disclosure the financial data management logic 515 stores and updates financial instrument data 518 in real-time.

In this regard, the system 500 further comprises a financial data computing device 516 that is communicatively coupled to the network 508 via a communication link 512. The financial data computing device 516 may be, for example, the National Association of Securities Dealers Automated Quotation (NASDAQ) computing device. The financial computing device 516 comprises a financial data management logic 510 that stores financial data 517 related to a class of financial instruments, such as stocks, mutual funds, ETFs, bonds, options, futures, swaps, caps, floors, obligations, or the like.

In such an embodiment, the financial data management logic 515 of the investing game computing device 501 communicates with the financial data management logic 510 of the financial data computing device 516. In this regard, the financial data management logic 515 from time-to-time polls the financial data management logic 510 to determine if any updates have been made to the financial data 517.

If there have been updates to the financial data 517, the financial data management logic 515 requests from the financial data management logic 510 updated financial data 517. In response, the financial data management logic 510 retrieves updated data from the financial data 517 and transmits the financial data 517 to the financial data management logic 515, which updates the financial data 518 with the downloaded real-time financial data 517. Thus, the investing card game may be played using real-time or historical financial data.

In yet another embodiment, if the financial data 517 is already available in the memory of the investing game computing device 501, e.g., through a compact disc (CD) created by the financial data computing device 516, then the network 512 and the time-to-time polls to the financial data management logic 510 are optional.

Note that the disclosure may also be practiced in a distributed computing environment where tasks or instructions of investing game computing device 501, financial data computing device 516 and client computing devices 502 and 503 are performed by multiple computing devices communicatively coupled to the network.

Figure 6:
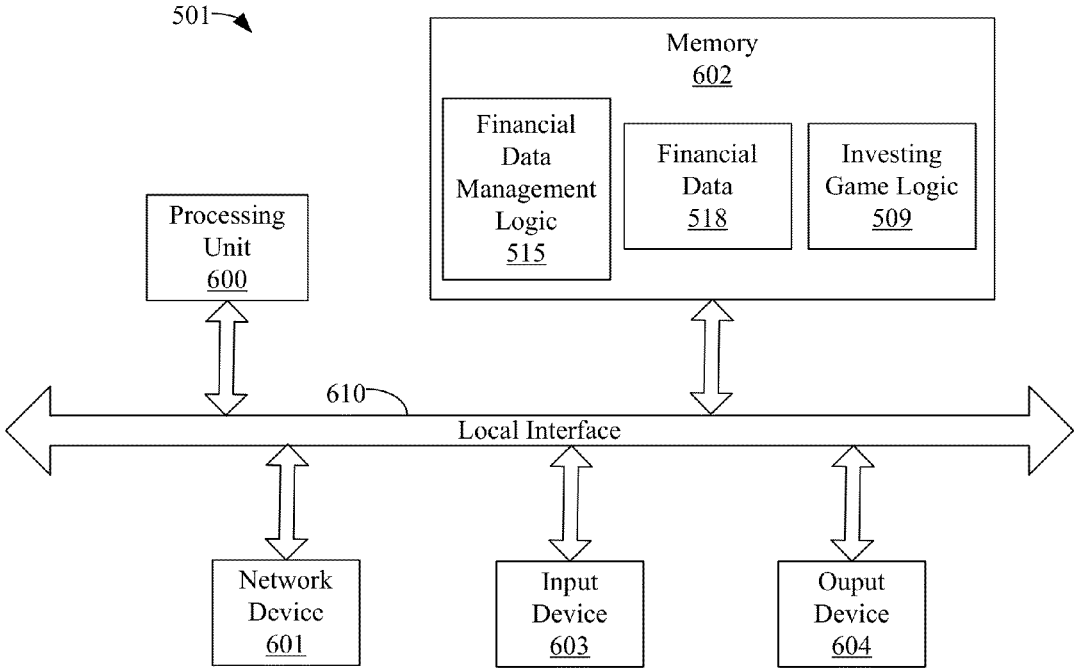
FIG. 6 depicts an exemplary gaming computing device of the system depicted in FIG. 5.

FIG. 6 depicts an exemplary investing game computing device 501 in accordance with an embodiment of the present disclosure. The exemplary embodiment of the investing game computing device 501 depicted by FIG. 6 includes a processing unit 600, memory 602, one or more input/output devices 603, one or more output devices 604, and a network device 601.

The investing game computing device 501 further comprises the financial data management logic 515, and the investing game logic 509. The financial data management logic 515 and the investing game logic 509 may be implemented in software, firmware, hardware, or any combination thereof. In the exemplary investing game computing device 501 depicted by FIG. 6, the financial data management logic 515, the investing game logic 509 are implemented in software and stored in memory 602.

In addition, the investing game computing device 501 further comprises the financial data 518. The financial data 518 comprises data indicative of a plurality of electronic financial instrument playing card s comprising data indicative of identifying the financial instrument and a set of statistics related to the financial instrument at a particular instance of time. In the exemplary investing game computing device 501 depicted by FIG. 6, the financial data 518 is implemented in software and stored in memory 602.

The memory 602 may be any type of computer memory known the art or future-developed for electronically storing data and/or logic, including volatile and non-volatile memory. In this regard, memory 602 can include random access memory (RAM), read-only memory (ROM), flash memory, any magnetic computer storage device, including hard disks, floppy discs, or magnetic tapes, and optical discs.

The processing unit 600 comprises processing hardware for executing instructions stored in memory 602. The processing unit 600 further communicates to and drives the other elements within investing game computing device 501 via a local interface 610, which can include at least one bus. Note that the processing unit 600 may be a digital processor (DSP) or other type of circuitry configured to run and/or execute the instructions contained in the financial data management logic 515, and the investing game logic 509.

The network device 601 may be any type of network device (e.g., a modem) known in the art or future-developed for communicating over the network 508 (FIG. 5). In this regard, the investing game computing device 501 communicates with the client computing device 502 (FIG. 5), the client computing device 503 (FIG. 5), and the financial data computing device 516 (FIG. 5) over the network 508 via the network device 601.

The input device 603 is any type of input device known in the art or future-developed for receiving data from the user. As an example, the input device 603 may be a keyboard, a mouse, a touch screen, a serial port, a scanner, a camera, or a microphone. Notably, only one input device 603 is shown in FIG. 6; however, the system 501 may include additional input devices in another embodiment.

The output device 604 is any type of output device known in the art or future-developed for displaying data to the user. As an example, the output device 205 may be a liquid crystal display (LCD) or other type of video display device, a speaker, or a printer. Notably, only one output device 604 is shown in FIG. 6; however, the system 501 may include additional output devices in another embodiment.

Figure 7:
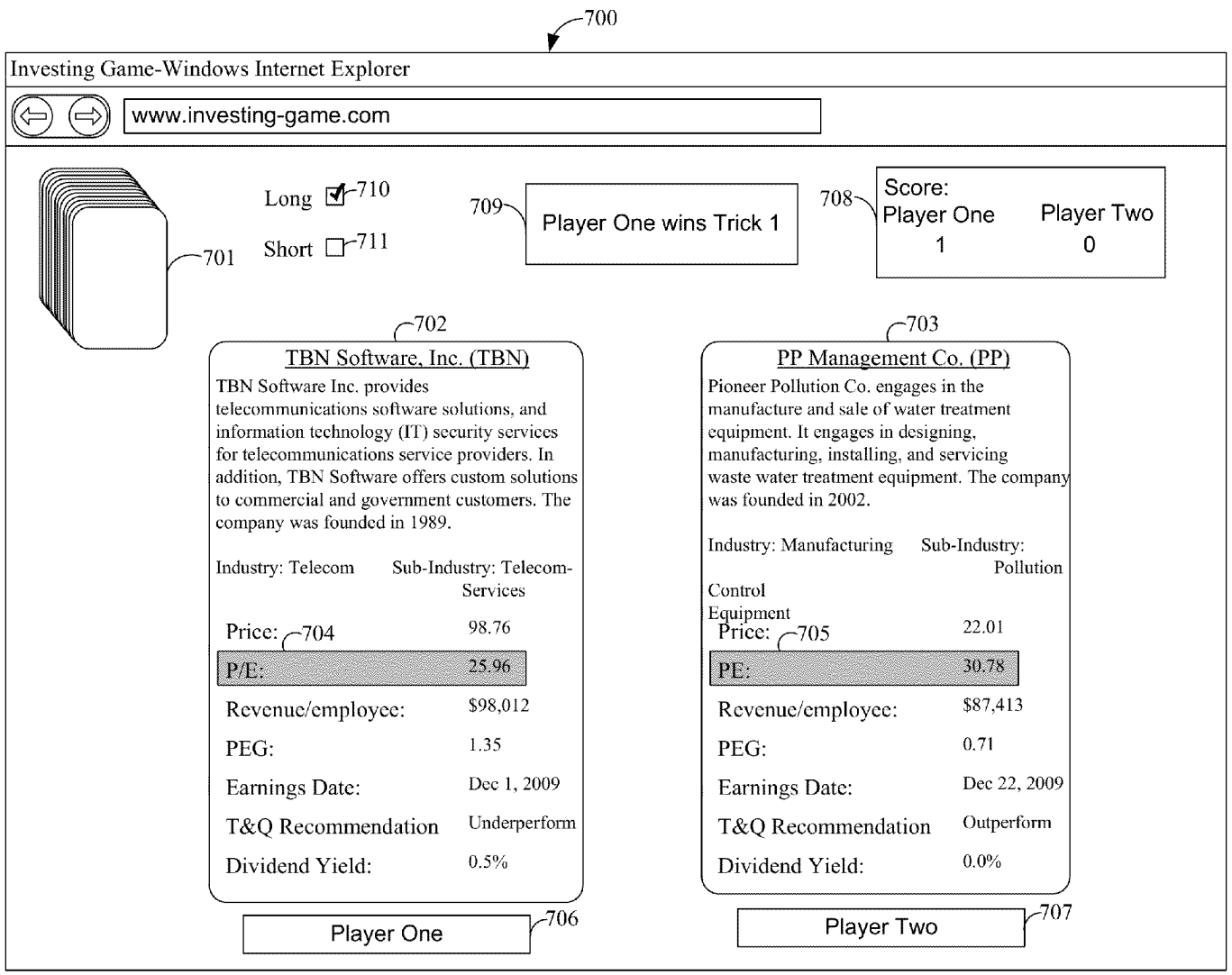
FIG. 7 depicts an exemplary graphical user interface displayed by the gaming computing device of FIG. 6.

FIG. 7 depicts an exemplary graphical user interface (GUI) 700 that is generated by the investing game logic 509 (FIG. 5) in accordance with an embodiment of the present disclosure. As described herein, the investing game logic 509 may allow multiple players to play over the network 508 (FIG. 5). In other embodiments, parts of the investing game logic 509 and financial data 518 may be downloaded to the client computing device 502 (FIG. 5) or the client computing device 503 (FIG. 5), and the game player 504 (FIG. 5) and the game player 505 (FIG. 5) could play one another directly over the network 508 without the use of the investing game computing device 501.

In yet another embodiment, as described herein, parts of the investing game logic 509 and financial data 518 may be downloaded to the client computing device 502 or the client computing device 503 and the game player 504 and the game player 505 could play against the "house," i.e., a computer-generated and controlled imaginary player. In such an embodiment, the investing game logic 509 would perform the tasks that are performed as described hereinabove for a player playing the investing card game. In this regard, the investing game logic 509 would receive an electronic deck of cards and automatically play the investing card game against the "real" player, i.e., a human being controlling a computer, who is controlling the system 501.

In one embodiment, the imaginary player may be a passive player or an active player. A passive imaginary player is same as a "real" player except that he does not initiate the round. An active imaginary player unlike passive imaginary can initiate a round. The additional logic that is required which will help the active imaginary player select a key/value if the active imaginary player is the initiating player may be part of the investing game logic 509.

In yet another embodiment, as described herein, parts of the investing game logic 509 and financial data 518 may be downloaded to the client computing device 502 or client computing device 503 and the game player 504 and the game player 505 may play using the same client computing device 502 or the same client computing device 503.

The GUI 700 depicts one embodiment of the investing game logic 509 wherein game player 504 and game player 505 play one another in an Internet browser, e.g., Internet Explorer™. In such an embodiment, the investing game logic 509 reading or otherwise accessing financial data 518 generates the data that is to be included in any Web page, e.g., GUI 700, that is to be displayed by the Web browser logic 506 and the Web browser logic 507, respectively, to the display devices (not shown) of the client computing device 502 and the client computing device 503. The investing game logic 509 then transmits data indicative of the Web pages to be displayed to the client computing device 502 and the client computing device 503, and the Web browser logic 506 and the Web browser logic 507 displays via the display devices the Web pages defined by the data received from the investing game logic 509.

The electronic investing card game is now described with reference to GUI 700 in FIG. 7. Assume for illustration purposes that GUI 700 is displayed by the Web browser logic 506 (FIG. 5) to the display device (not shown) of the client computing device 502. Further, for illustration purposes, game player 504 is identified as "Player One" and game player 505 identified as "Player Two." Further assume that game player 504 is playing game player 505 (FIG. 5), and a similar GUI (not shown) is displayed via the display device (not shown) of the client computing device 503.

In this regard, the GUI 700 comprises a graphical element 701 depicting a deck of investing game electronic cards that may be selected via an input device 603 (FIG. 6) (not shown), such as, for example a mouse by the game player 504. Note that the GUI (not shown) that is displayed to the display device of the client computing device 503 also comprises a similar graphical element depicting a deck of investing game electronic cards that may be selected via an input device (not shown), such as, for example, a mouse, by the game player 505.

Assume now for illustration purposes that game player 504 is the initiating player, i.e., the player that plays a card first in the game. In this regard, the game player 504 selects a playing card from the deck of cards depicted by the graphical element 701. In one embodiment, the game player 504 clicks on the graphical element of the deck of cards graphical element 701, and the web browser logic 506 through the client computing device 502 and the network 508 communicates the click event to the investing game logic 509 (FIG. 5) which in turn retrieves from financial data 518 (FIG. 5) data indicative of a financial instrument, including data indicative of a description of the financial instrument and data indicative of a set of statistics related to the financial instrument at a particular instance of time. In such an embodiment, the financial data 518 indicative of the financial instrument is selected by the investing game logic 509. In another embodiment, the graphical element 701 depicting the deck of cards may show to the user the front surface of the cards, i.e., the user may be able to scroll through each of the cards and select a card from the deck of cards for play, and the web browser logic 506 through the client computing device 502 and the network 508 communicates the desired selection card to the investing game logic 509 which in turn would retrieve from the financial data 518 the financial data corresponding to the card selected by the game player 504. The investing game logic 509 using the retrieved financial data corresponding to the card selected by the game player 504 generates data indicative of an electronic playing card 702.

The investing game logic 509, in one embodiment, further retrieves from financial data 518 data indicative of a second financial instrument, including data indicative of a description of the financial instrument and data indicative of a set of statistics related to the second financial instrument at a particular instance of time, belonging to the same class as the first financial instrument but differing from the first financial instrument or from a different instance of time from the first financial instrument card with identical statistical keys for game player 505. In another embodiment, the game player 505 using the graphical element 701 depicting the deck of cards may scroll through each of the cards and select a card from the deck of cards for play, and the web browser logic 507 through the client computing device 503 and the network 508 communicates the desired selection card to the investing game logic 509 which in turn would retrieve from the financial data 518 the financial data corresponding to the card selected by the game player 505. The investing game logic 509, using the retrieved financial data corresponding to the second financial instrument generates data indicative of an electronic playing card 703.

The investing game logic 509 transmits the electronic playing card 702 to the client computing device 502. The investing game logic 509 further transmits the electronic playing cards 702 and 703 to the client computing device 503. The Web browser logic 506 then displays the electronic playing card 702 in association with a "Player One" identifier 706. The Web browser logic 507 then displays the electronic playing card 702 in association with a "Player One" identifier 706 and the electronic playing card 703 in association with a "Player Two" identifier 707. Thus, both game player 504 and game player 505 can view the card that has been selected by the game player 504 and generated by the investing game logic 509. Crucially, the game player 504 can not view the card that has been selected or generated for game player 505 yet.

The game player 504 peruses the financial data, including the financial instrument identifier and the set of statistics. Via the input device, the game player 504 then selects which statistic in the set of statistics that the game player desires to be compared in order to accomplish a "trick." Note that in such an embodiment, each of the statistics is a hyperlink that when selected requests a new Web page from the investing game logic 509.

Thus, the investing game logic 509, upon receiving the selection of the statistic, generates data indicative of the GUI 700 wherein the selected statistic is highlighted on both the electronic cards 702 and electronic card 703 and transmitted back to the client computing devices 502 and 503. Note that at this point game player 504 can see the front of the electronic card 703. As an example, in GUI 700, the game player 504 has selected the "PIE" statistic 704 for the first "trick." Thus, the investing game logic 509 has generated data indicative of the GUI 700 wherein the selected statistic 704 and 705 in both the GUI 700 displayed by Web browser logic 506 and the GUI (not shown) that is displayed to the game player 505 by the Web browser logic 507 is highlighted.

In addition, the investing game logic 509, upon receiving the selection of the statistic, compares the statistical element selected by game player 504 with the same statistical element contained in the electronic card 703 to determine the winner of the "trick."

In addition, the GUI 700 further comprises text box 709, which indicates the "trick" winner, i.e., Player One or Player Two. In the exemplary GUI 700, Player One's electronic card 702 has a PE of 25.96, whereas Player Two's electronic card 703 has a PE of 30.78. Therefore, as described herein, the lower the PE the better the stock purchase, so Payer One wins the "trick." Thus, the text box 709 in the exemplary GUI 709 comprises data indicating that Player One has won the trick.

In addition, GUI 700 comprises a "Score" text box 708. Each time one of the players wins a trick, the number corresponding to the winning player is incremented. Thus, in the exemplary GUI 700 this was "Trick 1" as indicated in text box 709, and the Score is Player One "1" and Player Two "0."

The investing card game logic 509 may be played in a long version or a short version, as described herein. In this regard, the GUI 700 additionally may comprise check boxes 710 and 711. If one of the game players 504 or 505 desires to play a long version of the investing card game logic 509, one of the game players 504 or 505 selects check box 710. If the one of the game players 504 or 505 desires to play a short version of the investing card game logic 509, one of the game players 504 or 505 selects check box 711. Note that the game players 504 and 505 may take turns in selecting the long version or the short version. Further, the long version and the short version may be selected per round or for the entire game.

While the investing card game method is described herein with particular rules and caveats, other rules and caveats may be used in other methods of the present disclosure. The present disclosure is not limited to the exact rules and caveats as described in the exemplary method.

The invention claimed is:

1. A system for playing an investing card game, comprising:

memory for storing financial data indicative of a plurality of electronic financial instrument cards, the financial data for each of the plurality of the electronic financial instrument cards comprising data indicative of the financial instrument and a set of statistics related to the financial instrument at a particular instance of time, the data indicative of the set of statistics comprising data indicative of a plurality of key/value pairs, each key/value pair comprising data indicative of a key identifying a type of statistic and a corresponding value for the key;

a display device; and logic configured to display a graphical element to the display device indicative of a deck of cards, the logic further configured to retrieve from memory first financial data corresponding to one of the plurality of electronic financial instrument cards based upon a selection of the graphical element by a first player, to display a first electronic financial instrument playing card comprising the first financial data to the display device, and to display a first player identifier corresponding to the first electronic financial instrument playing card, the logic further configured to receive a selection from the first player of one of a plurality of displayed first electronic financial instrument card key/value pairs, retrieve from memory for the second player financial data corresponding to one or more second player electronic financial instrument cards, display the second player electronic financial instrument card to the display device along with the second player identifiers upon selection by the first player of one of the plurality of displayed first electronic financial instrument card key/value pairs, the logic further configured to compare the value of the selected first player electronic financial instrument card key/value pair to the second player's electronic financial instrument card key/value pair having the same key as the selected first electronic financial instrument card key/value pair, and determining, based upon the comparison a prevailing electronic financial instrument playing card, the logic further configured to display to the display device data indicative of which player identifier is associated with the prevailing financial instrument playing card.

2. The system of claim 1, wherein the financial instruments represents stocks, mutual funds, ETFs, bonds, options, futures, swaps, caps, floors, obligations, securitized products, or derivatives.

3. The system of claim 1, wherein the logic is further configured to determine whether the selected key/value pair is neutral, and if the selected key/value pair is neutral, the logic is further configured to declare a winner the player opposing the player who selected the neutral key/value pair.

4. The system of claim 1, wherein the logic is further configured to determine which of the value of the selected key/value pair on the first electronic financial instrument card and the one or more values of the same key/value pair on the second player's financial instrument card is greater if the financial instrument is a better investment when the value of the selected key/value pair is greater according to generally accepted financial principles.

5. The system of claim 1, wherein the logic is further configured to determine which of the value of the selected key/value pair on the first electronic financial instrument card and the one or more values of the same key/value pair on the second player's financial instrument card is lesser if the financial instrument is a better investment when the value of the selected key/value pair is lesser according to generally accepted financial principles.

6. The system of claim 1, wherein the value of the selected key/value pair is one of a plurality of textual identifiers that are ranked in a pre-determined ranked order, the textual identifiers ranked in the order from the textual identifier indicating a less desirable financial instrument to a more desirable financial instrument.

7. The system of claim 6, wherein the logic is further configured to determine where in the ranked order of the textual identifiers is the value of the selected key/value pair on the first electronic financial instrument card and the one or more values of the same key/value pair on the second electronic financial instrument card.

8. The system of claim 6, wherein the logic is further configured to determine which of the values of the selected key/value pair on the first electronic financial instrument card and the one or more values of the same key/value pair on the second electronic financial instrument cards indicates a better investment based on the ranked order of the textual identifiers.

9. The system of claim 1, wherein the logic is further configured to allow the user to continue to select the graphical element to display a new electronic financial instrument playing card for subsequent tricks after the logic displays to the display device the data indicative of the player identifier associated with the prevailing financial instrument playing card for a predetermined amount of time.

10. The system of claim 9, wherein the logic is further configured to display to the display device a total of how many tricks have been won by each player identified by the player identifiers for the predetermined amount of time.

11. The system of claim 1, wherein the logic is further configured to allow the user to continue to select the graphical element to display a new electronic financial instrument playing card for subsequent tricks after the logic displays to the display device the data indicative of the player identifier associated with the prevailing financial instrument playing card until a set number of electronic financial instrument playing cards have been played.

12. The system of claim 11, wherein the logic is further configured to display to the display device a total of how many tricks have been won by each player identified by the player identifiers.

13. The system of claim 1, wherein the logic is further configured to allow the user to continue to select the graphical element to display a new electronic financial instrument playing card for subsequent tricks after the logic displays to the display device the data indicative of the player identifier associated with the prevailing financial instrument playing card until a player associated with the first or second player identifier has won a predetermined number of cards.

14. The system of claim 13, wherein the logic is further configured to determine which of the two or more players has won the predetermined number of cards.

15. The system of claim 1, wherein the logic is further configured to receive an input from the user indicating that the user desires to play a long version of the investing card game or a short version of the investing card game.

16. The system of claim 15, wherein if the input indicates the long version of the investing card game, the prevailing electronic financial instrument card is the electronic financial instrument card having a value of the selected key/value pair that is greater or lesser than the one or more values of the financial instrument cards of the opposing players as defined by generally accepted financial principles for long financial instruments.

17. The system of claim 15, wherein if the input indicates the short version of the investing card game, the prevailing electronic financial instrument card is the electronic financial instrument card having a value of the selected key/value pair that is greater or lesser than the one or more values of the financial instrument cards of the opposing players as defined by generally accepted financial principles for short financial instruments.

18. The system of claim 1, wherein the logic is further configured to display a wild card.

19. The system of claim 18, wherein the displayed wild card wins the trick in a long version of the investing card game.

20. The system of claim 18, wherein the displayed wild card loses the trick in a long version of the investing card game.

21. The system of claim 18, wherein the displayed wild card wins the trick in a short version of investing card game.

22. The system of claim 18, wherein the displayed wild card loses the trick in a short version of investing card game.

23. The system of claim 1, wherein the second player is a computer-generated player and the logic is further configured to automatically play the investment card game with the first player.

* * * * *